US008282786B2

(12) United States Patent
Kim et al.

(10) Patent No.: US 8,282,786 B2
(45) Date of Patent: Oct. 9, 2012

(54) FEEDING OF COMBUSTION AIR FOR COKE OVENS

(75) Inventors: Ronald Kim, Essen (DE); Franz-Josef Schuecker, Castrop-Rauxel (DE)

(73) Assignee: UHDE GmbH, Dortmund (DE)

( * ) Notice: Subject to any disclaimer, the term of this patent is extended or adjusted under 35 U.S.C. 154(b) by 552 days.

(21) Appl. No.: 11/920,482

(22) PCT Filed: May 23, 2006

(86) PCT No.: PCT/EP2006/004871

§ 371 (c)(1),
(2), (4) Date: Nov. 12, 2008

(87) PCT Pub. No.: WO2006/128612

PCT Pub. Date: Dec. 7, 2006

(65) Prior Publication Data

US 2009/0152092 A1 Jun. 18, 2009

(30) Foreign Application Priority Data

Jun. 3, 2005 (DE) ..... 10 2005 025 955

(51) Int. Cl.
*C10B 47/08* (2006.01)
*C10B 47/10* (2006.01)
*C10B 21/10* (2006.01)

(52) U.S. Cl. ..... 201/27; 201/36; 202/135; 202/151; 202/248

(58) Field of Classification Search ..... 201/27, 201/36; 202/135, 151, 248, 108, 121, 149
See application file for complete search history.

(56) References Cited

U.S. PATENT DOCUMENTS 330,731 A * 11/1885 Pierce ..... 201/27
1,907,202 A * 5/1933 Ryan ..... 201/1

FOREIGN PATENT DOCUMENTS

DE 102 01 985 A1 7/2003

OTHER PUBLICATIONS

Buss, Walter E., et al.; "Thyssen Still Otto/PACTI nonrecovery cokemaking system"; Iron and Steel Engineer, Jan. 1999; XP-000799176; pp. 33-38, vol. 76, No. 1; Association of Iron and Steel Engineers, Pittsburgh, Pennsylvania, US.

* cited by examiner

*Primary Examiner* — Jill Warden
*Assistant Examiner* — Joye L Woodard
(74) *Attorney, Agent, or Firm* — Marshall & Melhorn, LLC

(57) ABSTRACT

Device for burning coking gas in a coking chamber of a coke oven of the "non-recovery type" or "heat-recovery type", a multiplicity of inlet openings for primary air being arranged in the roof of each oven chamber in such a way that the coking gas produced during the coking is brought into uniform contact with the desired quantity of primary air for the partial combustion of the coking gas, these inlet openings for primary air being combined above the oven for each chamber separately by an air feed system, the air feed systems of the individual oven chambers being connected to an air feed system common to many oven chambers, and a respective control member for varying the primary air quantity over the carbonizing time being provided between the common air feed system and the air feeds of the individual oven chambers. A slight, constant positive pressure can be applied to the common air feed system.

5 Claims, 1 Drawing Sheet

FEEDING OF COMBUSTION AIR FOR COKE OVENS

BACKGROUND OF THE INVENTION

The invention relates to a device and a process for feeding combustion air required to burn coking gas that is released above the coal bed when coal is coked in coking plants with coking chambers, using the Non-Recovery process or Heat-Recovery process. The process described in this application is independent of the number of coke ovens, provided they form a battery. DE 102 01 985 A1, for example, describes a device of this type.

Heat Recovery coke ovens, as a rule, are heated by burning the gas obtained during the coking process. The combustion is controlled in such a manner that part of the gas is burned in the oven chamber above the coal inventory with the aid of primary air. This partly burned gas is conveyed through ducts also named "downcomer" to the heating flues arranged in the sole slab of the oven chamber and subsequently it is completely burned by adding further combustion air also named secondary air.

Hence, this method is used to transfer heat to the coal charge directly from above and indirectly from the lower side, an effect that is beneficial to the coking velocity and also to the performance of the oven. For the implementation of the process it is necessary that the air fed to the section above the coal charge (primary air) be exactly metered and varied in control via the duration of the coking period. In order to ensure a uniform heat development across the entire coal charge, it is necessary that the combustion air be dispersed in as fine a manner as possible across the entire coal charge.

According to the state-of-the-art technology, primary air is taken in through openings in the doors, the said openings being equipped with devices for manual adjustment of the air flow rate. In practice, however, the air taken in directly reacts upon entering the oven and the desired partial combustion thus cannot take place. Part of the coking gas instead undergoes an almost complete reaction near the air inlet openings of the doors, whereas the residual part of the coking gas is not burnt because of lack of oxygen.

Hence, the heat development is by no means uniform across the whole coal charge, which inevitably leads to an equivalent heat input with unfavourable heat distribution in the coal bed.

BRIEF SUMMARY OF THE INVENTION

The aim of the invention, therefore, is to overcome the deficiencies described and to apply efficient means to solve this task by the following means:

The ceiling of each oven chamber is provided with a plurality of inlet openings for primary air, the said inlets being arranged such that the coking gas obtained during the coking process comes into contact with the desired quantity of primary air in a uniform manner;

the said inlet openings for primary air are grouped above the oven for each chamber so that a separate feed can be operated via an air feeding system;

the air feeding systems of the individual oven chambers are connected to a common air supply header system;

and one control device each is installed between the common air supply header system and the individual feeders of the oven chambers so that the primary air quantity can be adjusted via a variation of the coking period.

In accordance with an embodiment of the invention, the common air supply system is slightly pressurized at a constant value that suffices to overcome the line resistance in the air supply system and counteracts the stack effect in the openings. It is recommended that this pressurisation be carried out by means of a blower. The air supply and feed systems are constructed as piping or duct systems.

BRIEF DESCRIPTION OF THE DRAWINGS

The FIGURE illustrates a coking chamber in accordance with an embodiment of the present invention.

DETAILED DESCRIPTION OF THE INVENTION

Figure 1:
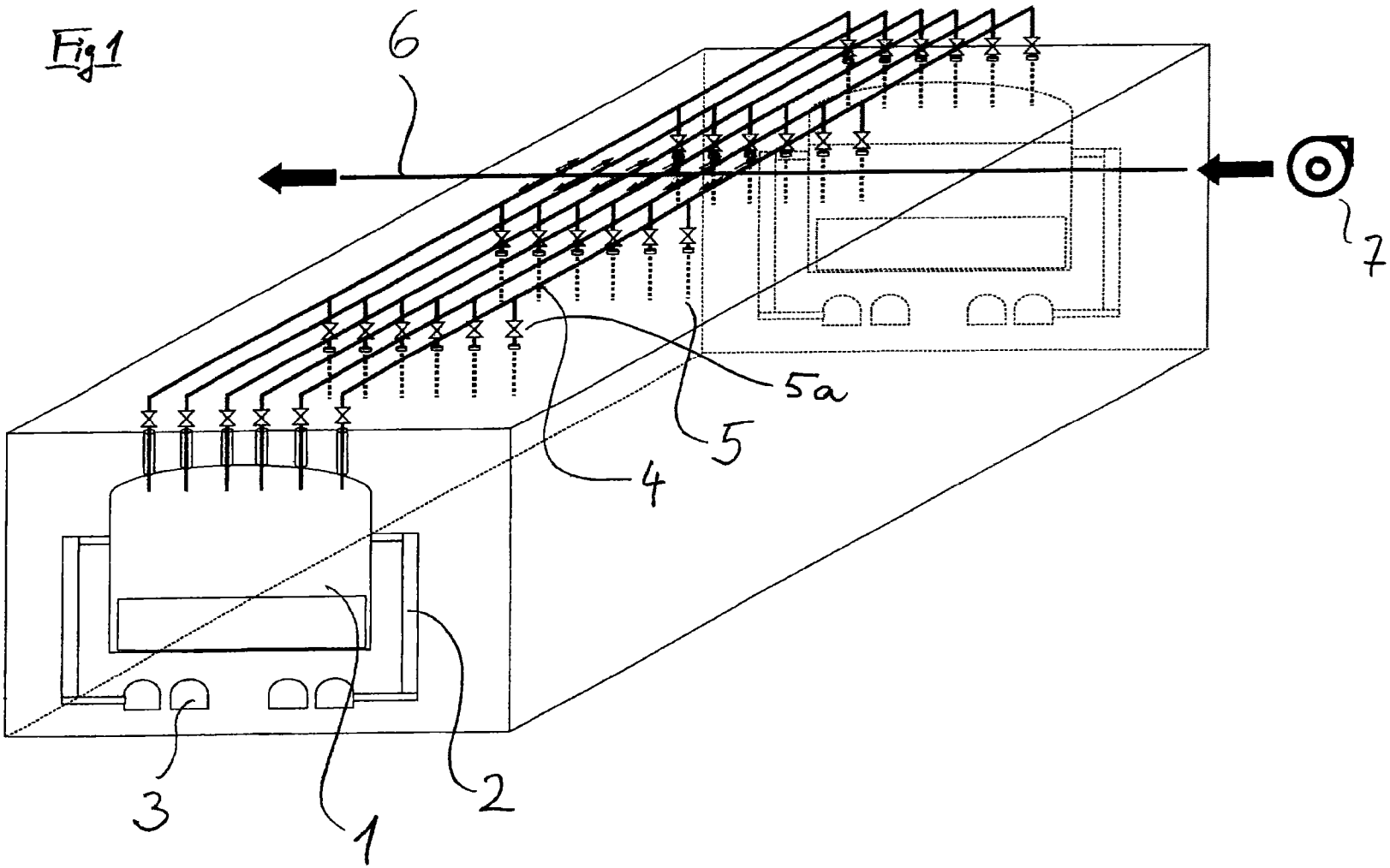

The attached diagrams and charts serve to illustrate the said system, FIG. 1 showing a schematic and perspective view of the coking chamber, using the Heat- Recovery process, with coke filling opening 1, downcomer system 2 and ducts 3 arranged underneath and required to evacuate the combustion gases, and the said ducts 3 may be equipped with internal post-combustion devices.

The system arranged above the coking chamber consists of feed lines 4, each being connected with a plurality of feed openings 5. The said feed lines 4 are connected to a common header system 6, which is slightly pressurised by means of a blower 7. At least one control device 5*a* is installed between the common air supply header system 6 and the individual feed openings 5.

LIST OF REFERENCE DESIGNATIONS

1 Coke filling opening
2 Downcomer system
3 Ducts
4 Feed lines
5 Feed openings
5*a* Control Device of Feed Openings
6 Collecting system
7 Blowers

The invention claimed is:

1. A device for feeding primary combustion air required to burn coking gas in a coking chamber above the coal inventory of a coke oven of the "Non-Recovery type" or "Heat-Recovery type", comprising:

at least one oven chamber, each of the at least one oven chambers having a ceiling:

the ceiling of each oven chamber is provided with a plurality of feed openings for primary air, the feed openings being arranged such that coking gas obtained during the coking process comes, in the coking camber, into contact with the desired quantity of primary air in a uniform manner;

the feed openings for primary air are grouped above the oven for each oven chamber and are on one hand connected to air feed lines so that a separate feed can be operated through a feed opening via an air feed line;

the air feed lines of the individual oven chambers are on the other hand connected to a common air supply header system;

and one control device each is installed in the feed openings between the common air supply header system and the individual air feed lines of the oven chambers so that the primary air quantity can be adjusted via the control devices for a variation of the coking period.

2. The device according to claim 1, wherein the common air supply header system is pressurizeable at a constant value.

3. The device according to claim 1, wherein the common air supply header system is pressurizable at a constant value by means of a blower.

4. A process for feeding combustion air required to burn coking gas by means of a device according to claim 1, wherein the primary air quantity into the coking chamber of the coke oven is fed via a common air supply header system and adjusted via the control devices in the plurality of feed openings.

5. The process for feeding combustion air required to burn coking gas according to claim 4, wherein the common air supply system is slightly pressurized at a constant value.

* * * * *